US007586249B2

(12) United States Patent
Jiang et al.

(10) Patent No.: US 7,586,249 B2
(45) Date of Patent: Sep. 8, 2009

(54) FIELD EMISSION DEVICE AND METHOD FOR MAKING THE SAME

(75) Inventors: Kai-Li Jiang, Beijing (CN); Yang Wei, Beijing (CN); Peng Liu, Beijing (CN); Liang Liu, Beijing (CN); Shou-Shan Fan, Beijing (CN)

(73) Assignees: Beijing FUNATE Innovation Technology Co., Ltd., Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 422 days.

(21) Appl. No.: 11/434,382

(22) Filed: May 15, 2006

(65) Prior Publication Data

US 2007/0075619 A1 Apr. 5, 2007

(30) Foreign Application Priority Data

Sep. 30, 2005 (CN) ..... 2005 1 0100089

(51) Int. Cl.
*H01J 9/02* (2006.01)

(52) U.S. Cl. ..... 313/310

(58) Field of Classification Search ..... 313/309, 313/310, 336, 351

See application file for complete search history.

(56) References Cited

U.S. PATENT DOCUMENTS

| | | | | |
|---|---|---|---|---|
| 6,683,783 | B1 * | 1/2004 | Smalley et al. | 361/502 |
| 2002/0104603 | A1 | 8/2002 | Chang et al. | |
| 2002/0175618 | A1 | 11/2002 | Lee et al. | |
| 2004/0053780 | A1 | 3/2004 | Jiang et al. | |

FOREIGN PATENT DOCUMENTS

| | | |
|---|---|---|
| JP | 2000251614 | 9/2000 |
| JP | 2001076651 | 3/2001 |

* cited by examiner

*Primary Examiner*—Vip Patel
(74) *Attorney, Agent, or Firm*—D. Austin Bonderer

(57) ABSTRACT

A field emission device (10) includes a base (12), a conductive paste (16), and at least one carbon nanotube yarn (14). The at least one carbon nanotube yarn is attached to the base using the conductive paste. This avoids separation of the at least one carbon nanotube yarn from the base by electric field force in a strong electric field. A method for making the field emission device includes the steps of: (a) providing a base; (b) attaching at least one carbon nanotube yarn to the base using conductive paste; and (c) sintering the conductive paste to obtain the field emission device with the carbon nanotube yarn firmly attached to the base.

14 Claims, 2 Drawing Sheets

FIELD EMISSION DEVICE AND METHOD FOR MAKING THE SAME

BACKGROUND

1. Technical Field

The present invention relates to field emission devices, and particularly to a field emission device using carbon nanotube yarns as emitters and method for making the field emission device.

2. Discussion of Related Art

Field emission materials are used in a variety of application such as flat panel displays to emit electrons. Typical field emission materials include, for example, molybdenum (Mo), tantalum (Ta), silicon (Si), and diamond. However, such materials need high emission voltages to emit electrons, and cannot carry high electric current reliably. Carbon nanotubes typically have superior performance including, in particular, good electron emission capability at low emission voltages, generally less than 100 volts. Furthermore, carbon nanotubes can carry high electric current reliably Due to these properties, carbon nanotubes are considered to be an ideal field emission material for a variety of applications, especially in field emission displays.

Carbon nanotube-based field emission devices typically include a base acting as a cathode plate, and a carbon nanotube array acting as an emitter formed on the base. Methods for forming the carbon nanotube array on the base typically include mechanical means and in situ growth. The mechanical means consists of fixing carbon nanotubes onto the base with chemical agglutinant using a robot arm. Such a mechanical means is time consuming and difficult to operate. Furthermore, it is impossible to manipulate the carbon nanotubes with a diameter smaller than about 1 nm (nanometer).

The in situ growth process is generally performed as follows. Firstly, a catalyst film is deposited on a base. The base has a driving circuit preformed thereon. Secondly, a carbon nanotube array is grown on the base by a chemical vapor deposition (CVD) process. However, the carbon nanotube array is generally fabricated under a temperature in the range from 500 to 900° C. As a result, the driving circuit on the base may be damaged.

SUMMARY

An exemplary embodiment of the present field emission device is provided.

The field emission device includes a base, and at least one carbon nanotube yarn attached to the base.

A method for making the field emission device is also provided in the present invention. The method includes the steps of:

(a) providing a base; and (b) attaching at least one carbon nanotube yarn to the base.

BRIEF DESCRIPTION OF THE DRAWINGS

The above-mentioned and other features and advantages of the field emission device, and the manner of attaining them, will become more apparent and the invention will be better understood by reference to the following description of embodiments thereof taken in conjunction with the accompanying drawings. The components in the drawings are not necessarily drawn to scale, the emphasis instead being placed upon clearly illustrating the principles of the present apparatus and method. Moreover, in the drawings, like reference numerals designate corresponding parts throughout the several views.

Figure 1:
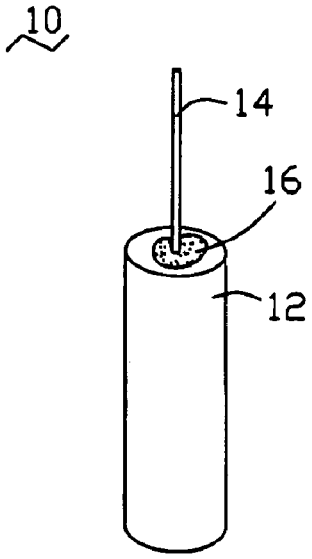
FIG. 1 is a schematic, isometric view of a field emission device employing one carbon nanotube yarn as an emitter according to a first preferred embodiment.

Corresponding reference characters indicate corresponding parts throughout the several views. The exemplifications set out herein illustrate at least one preferred embodiment of the invention, in one form, and such exemplifications are not to be construed as limiting the scope of the invention in any manner.

DETAILED DESCRIPTION OF PREFERRED EMBODIMENTS

Reference will now be made to the drawings to describe in detail the preferred embodiments of the present field emission device and a method for making thereof.

In order to improve manipulability, macroscopic carbon nanotube structures are proposed for use as emitters in the present embodiment. Assembling carbon nanotubes into macroscopic structures is of great importance to their applications at the macroscopic level.

That a long macroscopic carbon nanotube yarn can be drawn out from a superaligned carbon nanotube array has been disclosed in US Pub. No. 20040053780, which is incorporated herein by reference. A carbon nanotube yarn includes a plurality of carbon nanotube bundles that are joined end to end by van der Waals attractive force, and each of the carbon nanotube bundles includes a plurality of carbon nanotubes substantially parallel to each other. Each carbon nanotube bundle is joined with the carbon nanotubes adjacent to it at either end in a sideward direction instead of longitudinal direction, along an axial direction of the carbon nanotube of each of the carbon nanotube bundles. In general, the combined width of the carbon nanotube yarn can be controlled by a size of the tips of the tool that is used to pull out the carbon nanotube yarn. The smaller the tips, the thinner the combined width or the carbon nanotube yarn. A force required to pull out the carbon nanotube yarn together depends on the combined width of the carbon nanotube yarn. For example, a force of 0.1 mN is needed to pull out a 200 μm wide yarn from a superaligned carbon nanotube array. Generally, the greater the combined width of the carbon nanotube yarn, the greater the force required. A combined length of the carbon nanotube yarn depends on an area of the superaligned carbon nanotube array. Experimental data indicates that it may be possible to draw out a 10 m long 200 μm wide carbon nanotube yarn from a 100 μm high carbon nanotube array having an area of 1 $cm^2$.

Referring to FIG. 1, a field emission device 10 according to a first preferred embodiment of the present invention is shown. The field emission device 10 includes a base 12, and one carbon nanotube yarn 14 attached to the base 12. In the present embodiment, the carbon nanotube yarn 14 extends perpendicularly from a top surface of the base 12 and functions as an emitter.

The base 12 may be made of a metal, such as copper (Cu), nickel (Ni), and molybdenum (Mo). In the present embodiment, the base 12 is made of Cu. The base 12 may be cylinder, cuboid or other shape. The base 12 is a cylinder in the present embodiment.

The carbon nanotube yarn may be mechanically or metallurgically attached to the base. In the illustrated embodiment, the field emission device 10 further includes a conductive paste 16 applied between the carbon nanotube yarn 14 and the base 12, thereby attaching the carbon nanotube yarn 14 to the base 12. The conductive paste 16 is an electrically conductive material, such as silver paste.

A length of the carbon nanotube yarn 14 is in the range from 1 to 100 mm, and a width of that is in the range from 2 to 200 μm. In the present embodiment, the carbon nanotube yarn 14 has a length of about 60 mm and a width of about 100 μm.

An exemplary method for making the field emission device 10 is provided as follows, and includes the steps in no particular order of:

(1) providing a base 12;

(2) providing a superaligned carbon nanotube array with 100 μm high, 1 $cm^2$ area, pulling out a carbon nanotube yarn 14 from the superaligned carbon nanotube array;

(3) attaching the carbon nanotube yarn 14 to a top surface of the base 12 using silver paste 16; and (4) sintering the silver paste 16 at a temperature of between 400 and 550° C. for about 30 minutes to obtain the field emission device 10 with carbon nanotube yarn 14 extended perpendicularly from the top surface of the base 12.

It is understood that, in step (2), if the carbon nanotube yarn 14 is long enough, the carbon nanotube yarn 14 can be cut into a plurality of sections/segments, one of which is then selected to serve as the field emitter.

The silver paste 16 should be sintered in air, nitrogen, hydrogen, a mixture gas thereof, or a gas containing less than 30% of oxygen. Alternatively, the carbon nanotube yarn could be mechanically or metallurgically attached to the base.

The field emission device 10 can emit an electric current with 50 mA or above when a voltage of about 500V to 1000V is applied between the field emission device 10 and an anode electrode disposed 10 mm distant from the field emission device 10.

Figure 2:
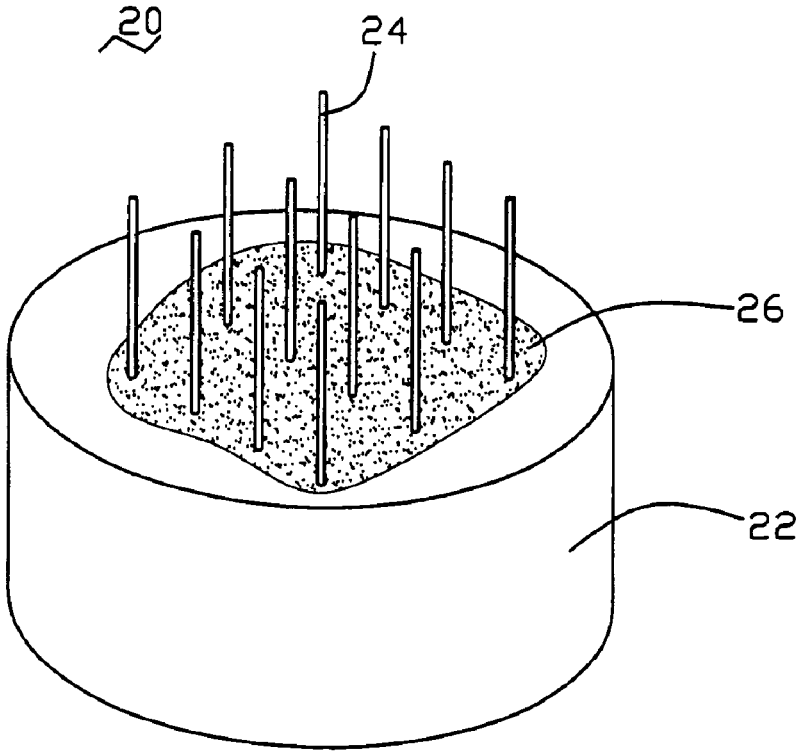
FIG. 2 is a schematic, isometric view of a field emission device employing a number of carbon nanotube yarns as emitters according to a second preferred embodiment.

It is understood that we can use a plurality of carbon nanotube yarns as emitters under the same condition. Referring to FIG. 2, a field emission device 20 of a second preferred embodiment of the present invention is shown. The field emission device 20 includes a columniform base 22 made of Cu, and a plurality of carbon nanotube yarns 24 attached to the base 22 and extending perpendicularly from a top surface of it. A conductive silver paste 26 is applied between the carbon nanotube yarns 24 and the base 22, thereby attaching the carbon nanotube yarns 24 to the base 22.

Figure 3:
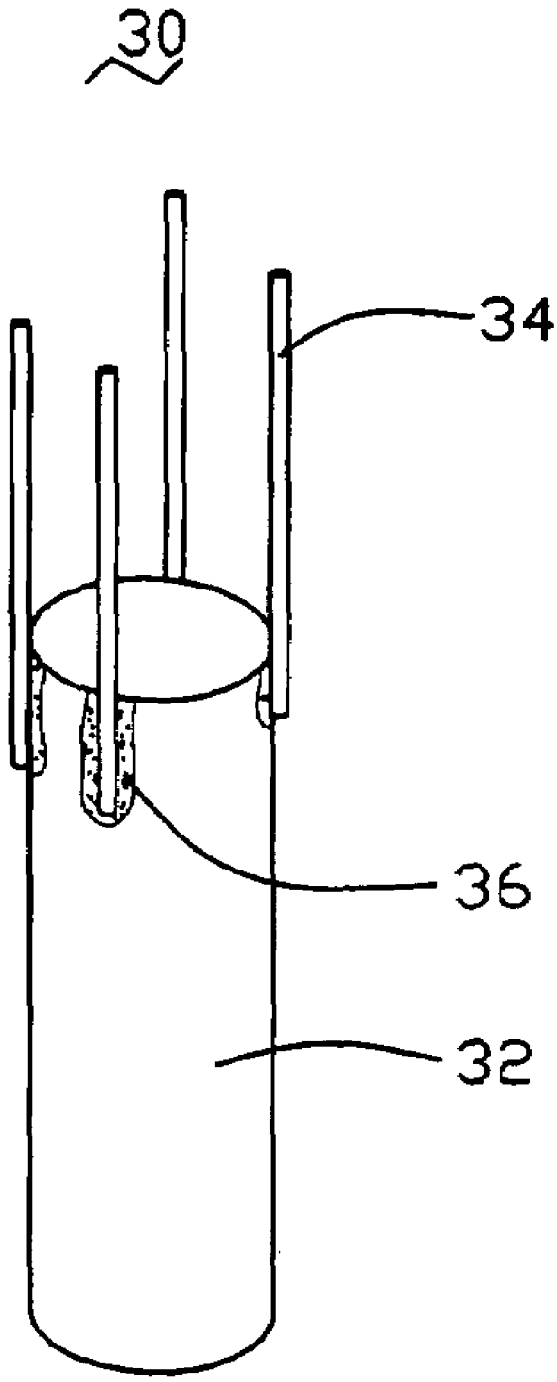
FIG. 3 is a schematic, isometric view of a field emission device according to a third preferred embodiment.

Referring to FIG. 3, a field emission device 30 having a plurality of carbon nanotube yarns as emitters according to a third preferred embodiment is shown. The field emission device 30 includes a columniform base 32 made of Cu, a plurality of carbon nanotube yarns 34 with 100 mm length and 200 μm width attached to the side surface of the base 32, and a layer of conductive silver paste 36 applied between the carbon nanotube yarns 34 and the base 32 for attaching the carbon nanotube yarns 34 to the base 32. In the present embodiment, the carbon nanotube yarns 34 extend from a side surface of the base 32. This configuration makes good use of the side surface area of the base 32 so as to enlarge a contact area between the carbon nanotube yarns 34 and the base 32.

The field emission device and method according to the present invention has the following advantages. Firstly, the carbon nanotube yarns as field emitters of the field emission device can emit high electric current reliably. Secondly, in the present method, the at least one carbon nanotube yarn is attached to a base using a conductive paste. The conductive paste is then sintered for fixing the at least one nanotube to the base. The temperature for sintering the conductive paste is generally in a range of 400 to 550° C. and is far lower than the operation temperature of 500 to 900° C. in the conventional in situ growth method. This avoids damage of the driving circuit on the base.

While the present invention has been described as having preferred or exemplary embodiments, the embodiments can be further modified within the spirit and scope of this disclosure. This application is therefore intended to cover any variations, uses, or adaptations of the embodiments using the general principles of the invention as claimed. Furthermore, this application is intended to cover such departures from the present disclosure as come within known or customary practice in the art to which the invention pertains and which fall within the limits of the appended claims or equivalents thereof.

What is claimed is:

1. A field emission device, comprising:

a base; and at least one carbon nanotube yarn attached to the base, the at least one carbon nanotube yarn comprising a plurality of carbon nanotube segments, the carbon nanotube segments being joined end to end by van der Waals attractive force.

2. The field emission device as described in claim 1, wherein the at least one carbon nanotube yarn includes a plurality of parallel carbon nanotubes extending in a common direction.

3. The field emission device as described in claim 1, further comprising a conductive paste applied between the at least one carbon nanotube yarn and the base, thereby attaching the at least one carbon nanotube yarn to the base.

4. The field emission device as described in claim 3, wherein the conductive paste comprises silver paste.

5. The field emission device as described in claim 1, wherein the base is comprised of a material selected from the group consisting of copper, nickel, and molybdenum.

6. The field emission device as described in claim 1, wherein the at least one carbon nanotube yarn extends perpendicularly from a top surface of the base.

7. The field emission device as described in claim 1, wherein the at least one carbon nanotube yarn extends from a side surface of the base.

8. The field emission device as described in claim 1, wherein the each of the carbon nanotube segments comprises a plurality of carbon nanotubes substantially parallel to each other.

9. The field emission device as described in claim 8, wherein the adjacent two nanotube segments are joined with each other at respective ends in a sideward direction instead of longitudinal direction along an axial direction of the nanotube of each of said nanotube segments.

10. The field emission device as described in claim 1, wherein a length of the at least one carbon nanotube yarn is in the range from about 1 to about 100 millimeters.

11. The field emission device as described in claim 1, wherein a width of the at least one carbon nanotube yarn is in the range from about 2 to about 200 microns.

12. The field emission device as described in claim 1, wherein the at least one carbon nanotube yarn is a drawn carbon nanotube yarn.

13. The field emission device as described in claim 4, wherein the silver paste is sintered in a gas containing less than 30% oxygen.

14. The field emission device as described in claim 3, wherein the temperature for sintering the conductive paste is in a range of about 400° C. to 550° C.

* * * * *

UNITED STATES PATENT AND TRADEMARK OFFICE

CERTIFICATE OF CORRECTION

PATENT NO. : 7,586,249 B2
APPLICATION NO. : 11/434382
DATED : September 8, 2009
INVENTOR(S) : Jiang et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 538 days.

Signed and Sealed this

Fourteenth Day of December, 2010

David J. Kappos

David J. Kappos
*Director of the United States Patent and Trademark Office*